United States Patent [19]

Kaminski

[11] 4,159,600

[45] Jul. 3, 1979

[54] METHOD FOR REPRODUCING PHOTOGRAPHS, DRAWINGS, OR THE LIKE, ON MARBLE OR GRANITE

[76] Inventor: Gerald P. Kaminski, 7395 Middlebury, Lambertville, Mich. 48144

[21] Appl. No.: 898,302

[22] Filed: Apr. 20, 1978

[51] Int. Cl.[2] ..... B24C 1/04

[52] U.S. Cl. ..... 51/312

[58] Field of Search ..... 51/312, 262; 118/505

[56] References Cited

U.S. PATENT DOCUMENTS

| | | | |
|---|---|---|---|
| 2,094,025 | 9/1937 | Scantlebury | 51/312 |
| 2,357,310 | 9/1944 | Burchell | 51/312 X |
| 2,671,978 | 3/1954 | Brusetti | 51/312 |
| 3,295,263 | 1/1967 | Savoca | 51/312 |
| 3,579,926 | 5/1971 | Gaspari | 51/312 |

*Primary Examiner*—Gary L. Smith

*Attorney, Agent, or Firm*—Henry K. Leonard

[57] ABSTRACT

A method for reproducing a photograph, drawing, or the like, hereinafter called the "original", on granite, marble or other hard stone, such as building corner stones, road markers, monuments, etc. The method consists in the steps of tracing onto the surface of a transparent acetate film the outlines of shaded areas of the original, placing the film on the surface of a first sheet of tough material that is capable of resisting the impingement of blasted sand and that is a member of a laminate which also comprises a transparent backing sheet adhered to the back of the tough sheet, removing the shaded areas from the tough sheet, cutting through the film and the laminate along the perimeter of the original to separate the laminate from the first sheet, placing a second sheet of tough material that is larger in area than the original onto the surface of the stone, tracing the perimeter of the original onto the second sheet and removing the entire traced original area therefrom, "dusting" the area of the stone from which the entire traced original area has been removed, adhering the cut out laminate to the surface of the stone in the open area of the second sheet, sand blasting through all of the cutout areas of both of the sheets of tough material and removing the sheets from the stone.

4 Claims, 6 Drawing Figures

FIG. 2
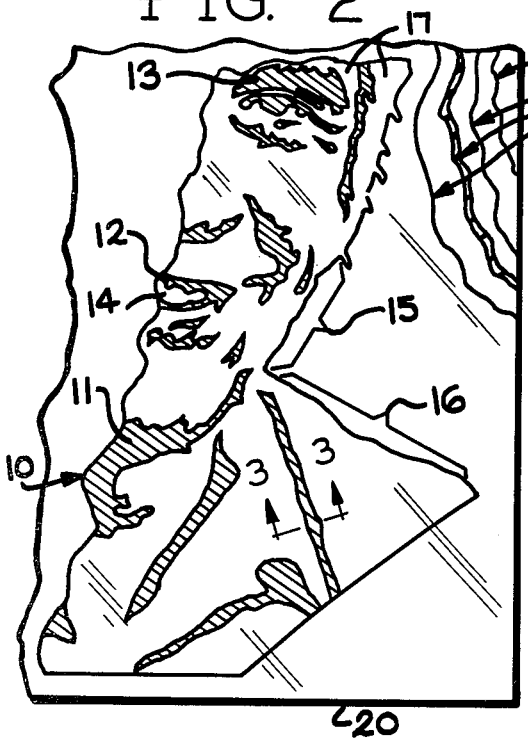
FIG. 3
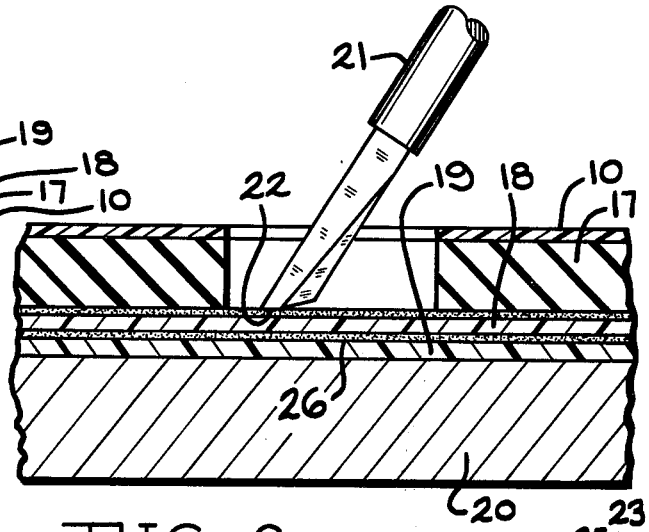
FIG. 6
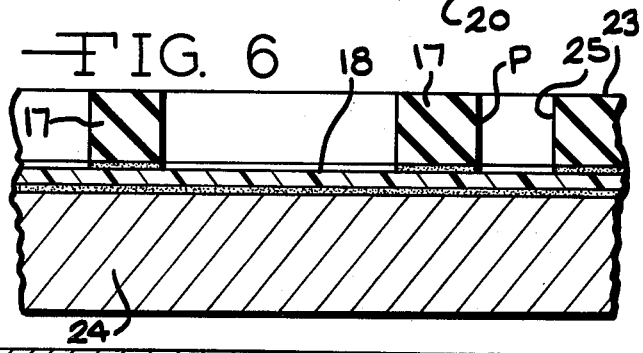
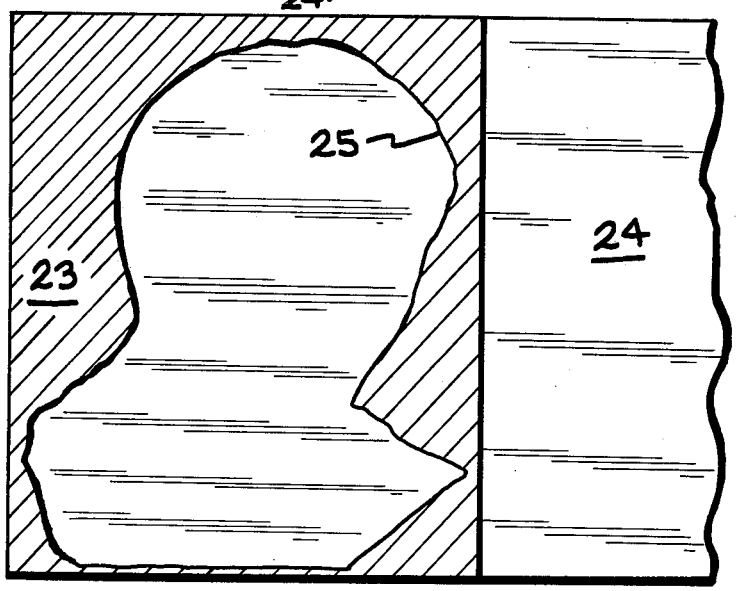
FIG. 4

METHOD FOR REPRODUCING PHOTOGRAPHS, DRAWINGS, OR THE LIKE, ON MARBLE OR GRANITE

BACKGROUND OF THE INVENTION

It is well known, of course, that things such as letters, numerals and even configurations, designs and portraits can be formed either intaglio or in bas-relief in the surface of hard stones such as marble and granite by sculpting them into the surface. It is also well known that things such as letters, numerals and geometric designs can be intaglio cut or left in bas-relief in such surfaces through the medium of a method generally known as sand-blasting.

However, the reproduction of photographs, shaded paintings or drawings, or the like, on or in the surface of a hard stone such as granite or marble, heretofor has not been known and no method has been suggested for achieving this result.

It is, therefore, the object of the instant invention to provide a method for reproducing on hard stones, such as marble or granite, an original representation such as a photograph, a shaded drawing or painting, or the like.

BRIEF DESCRIPTION OF THE DRAWINGS

FIG. 2 is a fragmentary drawing illustrating how a portion of the photograph of FIG. 1 is handled according to several steps of the method of the invention in order to enable its reproduction in stone;

FIG. 3 is a greatly enlarged, fragmentary, vertical sectional view taken along the line 3—3 of FIG. 2;

FIG. 4 is a view in elevation showing a fragment of a stone, such as a monument, a tombstone or the like, and illustrating one of the intermediate steps in the method of the invention;

FIG. 6 is a view similar to FIG. 3 but taken along the line 6—6 of FIG. 5.

DESCRIPTION OF PREFERRED EMBODIMENT

Figure 1:
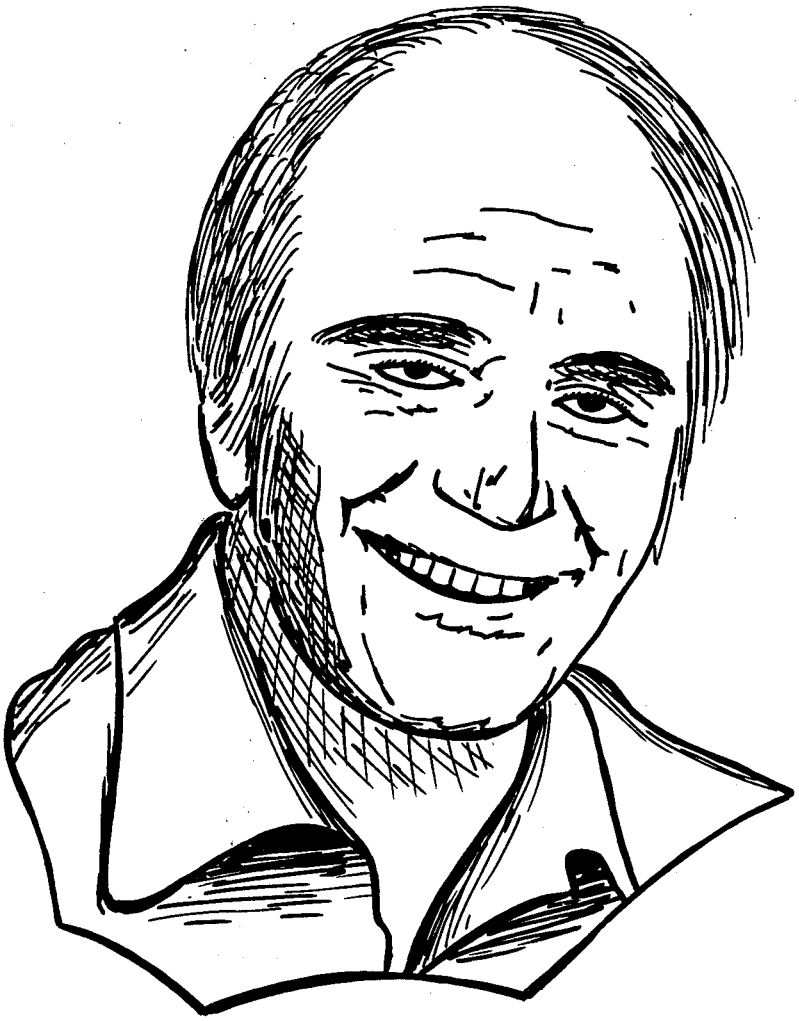
FIG. 1 is a drawing of an original photograph of the head of a person which is to be reproduced in the hard stone according to the invention.
Figure 5:
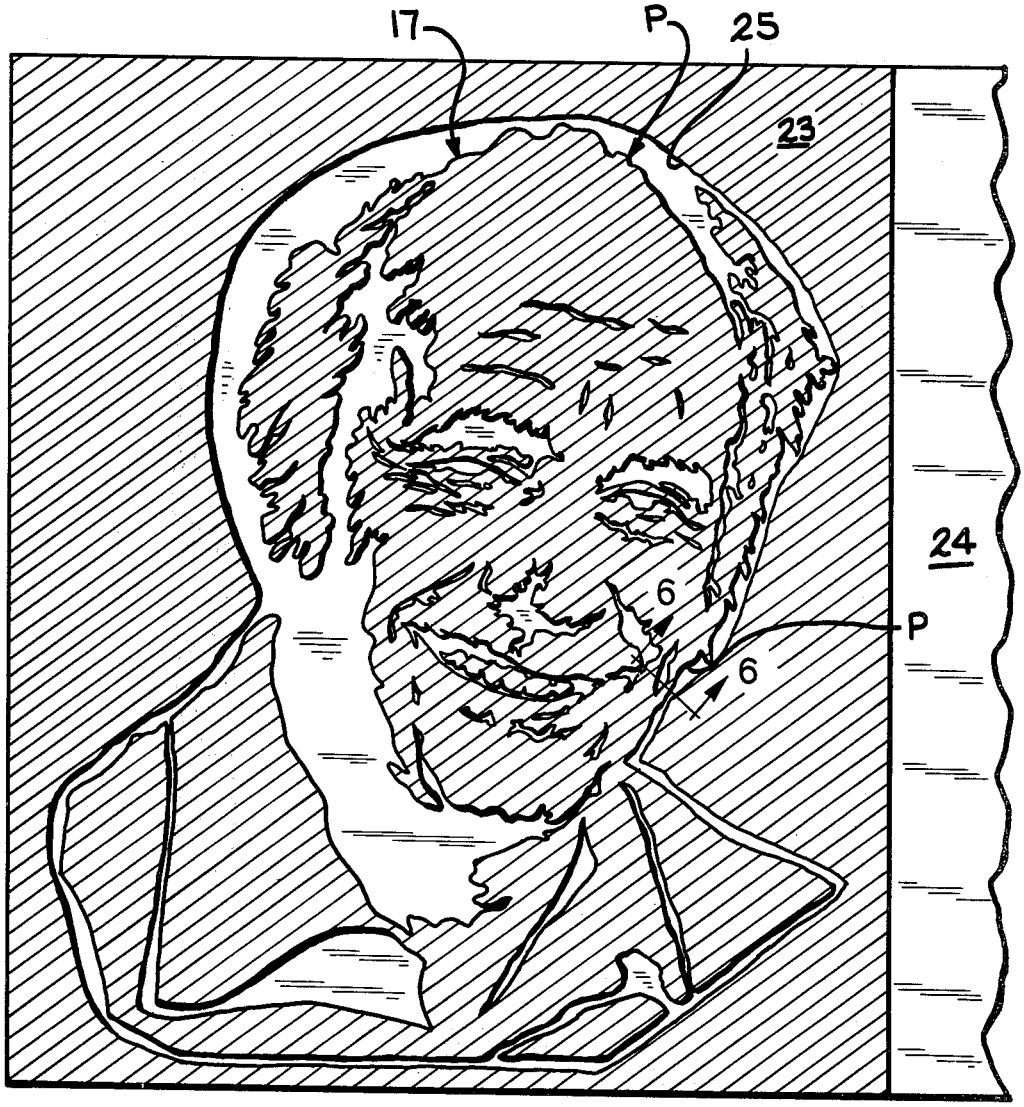
FIG. 5 is a view similar to FIG. 4 but on an enlarged scale illustrating a subsequent step in the method of the invention.

FIG. 1 is a view in front elevation of a drawing of a photograph of the type which can be reproduced in the surface of a hard stone, such as granite or marble, according to the method of the invention. Preferably any photograph to be used or any drawing or painting which is to be reproduced should have reasonably sharp contrast in order that the dark and shaded areas of the original have relatively sharp outlines. No attempt is made in the method of the invention to distinquish between shaded areas of varying darkness and, as will be later apparent, in the finished reproduction all shaded areas possess the same contrast to the highlighted areas.

The first step according to the invention is to place over the photograph of FIG. 1 a sheet of transparent film 10, such as a cellulose acetate sheet having a matte finish so that it will take pencil or pen lines. The operator then traces onto the matte finish side of the transparent sheet 10 outlines of the shaded areas in the photograph, for examples, as shown in FIG. 2, a shaded area 11 under the chin, a shaded area 12 which constitutes the outline of the lips of the person or a dark area 13 which is one of the eyebrows. Further considering the shaded area 12 which defines the lips or the mouth of the person, it will be noted that the teeth, indicated by the reference No. 14, are not shaded inasmuch as they are to be left white to contrast with the dark area of the lips as in the original photograph and as they will be in the final reproduction in stone.

After the shaded areas of the photograph have been outlined on the transparent matte sheet, the perimeter of the photograph also is outlined on the matte sheet. For example, a portion of the cheek, indicated by the reference No. 15 and the bracket connected thereto, forms a portion of this perimeter as does a section of the person's shoulder indicated by the reference No. 16 and the bracket connected thereto.

After all of the shaded or dark areas and the perimeter of the photograph have been outlined on the transparent matte film 10 the transparent film 10 is removed from the photograph and placed upon the surface of a laminate (FIG. 3) comprising a layer 17 of tough material capable of resisting sand blasting which is adhered to a backing sheet 18. The tough layer may be a rubber or synthetic rubbery material, say 1/16 of an inch thick, or so, which is known in the trade, and the backing sheet 18 is a relatively thin sheet of transparent film to which the layer of tough material tenaciously is adhered. Preferably, the back surface of the backing sheet 18 has on it a thin layer of contact adhesive and there is a protective sheet 19 spread over the contact adhesive layer.

By reference to FIG. 3 it will be seen that the next step in the method of the invention is to cut through the transparent film 10 on which the outlines of the shaded and dark areas and the perimeter have been traced along those lines and also to cut through the layer 17 of tough, resistant material as illustrated in that figure. Preferably, in order to facilitate this cutting operation, the operator places the laminate with the superposed transparent film 10 on a hard surface such as a table 20 and employs a cutting knife generally indicated with the reference No. 21 which has a blunt tip 22. After cutting through the transparent film 10 and the tough layer 17 completely around each of the dark or shaded areas, each of them is removed. When the operator cuts around the perimeter of the area as, for example, along the lines indicated by the brackets and reference numbers 15 and 16, he cuts all the way through the entire laminate including the tough sheet 17, the backing sheet 18 and the protective sheet 19. The entire cut-out laminate is then removed from the sheet in which it originally was present. Because the layer 17 of tough material is tenaciously adhered to the backing sheet 18, all of the portions thereof, whether connected to other portions or not, are retained in their respective positions as a depiction of the photograph.

A second sheet of tough material, indicated by the reference No. 23 in FIG. 4, is then placed upon a slab 24 of the stone into which the photograph is to be reproduced and the cut-out laminate placed thereon to act as a guide for cutting out of the second sheet 23 an area generally conforming and a little larger in size to the perimeter of the photograph. After removal of this outlined portion of the second sheet 23, a void 25 is left therein.

The operator then applies to the surface of the stone 24 which is now exposed through the void 25 a fine sand blasting, called "dusting" in the trade, to remove from the surface of the stone its polish and fine texture and thus to give this exposed area of the stone what might be called a "high-lighted" area.

After "dusting" through the void 24, the operator removes the transparent film 10 from the front surface of the layer 17 of the tough material and peels the protective layer 19 away from the rear surface of the backing sheet 18 exposing the layer 26 of pressure sensitive adhesive. The operator then places the entire laminate consisting of the remaining portions of the layer 17 of tough material and its backing sheet 18 in the void now defined by the second sheet of tough material 23, pressing the laminate against the surface of the stone.

This results in an assemblage as indicated in cross-section in FIG. 6 where the outline of the perimeter of the photograph is indicated by the letter "P" and the edge of the void in the second sheet 23 is indicated by the reference No. 25.

It will be noted that in FIG. 2 the dark and shaded areas are crosshatched to show where they are on the photograph of FIG. 1. In contrast, in FIG. 6, because those areas have been removed from the sheet 17, the remaining portions of the sheet 17 are crosshatched.

The operator then sand-blasts away the portions of the backing sheet 18 and those portions of the surface of the stone 24 which are not protected either by the remaining parts of the first layer 17 or the second sheet 23 of the tough material.

Those areas of the photograph which were shaded or dark in the original and which were traced or outlined on the transparent matte film 10 and removed from the layer 17, are thereby cut into the "dusted" area of the stone to result in their being dark as compared to those portions of the "dusted" area protected by the remaining portions of the sand-blast resistant layer 17 or sheet 23 and a reproduction of the original photograph results.

I claim:

1. A method for reproducing an original representation, such as a photograph, a drawing or the like, on stone such as granite, marble or the like, said method comprising the steps of:

(1) cutting areas corresponding to shaded areas of the original out of a first sheet of tough material that is capable of withstanding the impingement of blasted sand and that is a top layer of a laminate which also comprises a transparent backing sheet;

(2) cutting out of said laminate the entire area defined by the perimeter of the original;

(3) placing a second sheet of tough material that is larger in area than the original onto the surface of the stone;

(4) cutting out of said second sheet of tough material the entire area defined by the perimeter of the original;

(5) "dusting" the area of the stone from which the entire area of the original on the second sheet has been removed;

(6) placing the cutout laminate in the open area of said second sheet and adhering the laminate to the stone;

(7) sand blasting through all of the cutout areas of said sheets of tough material and (8) removing said sheets and said laminate from the stone.

2. A method according to claim 1 in which the shaded areas of the original are outlined on a transparent film which is placed over the original and the film is then superposed on the first sheet of tough material as a guide for cutting the shaded areas out of the laminate.

3. A method according to claim 2 in which the film has a matte surface on which the shaded areas are outlined.

4. A method according to claim 2 in which the backing sheet has a layer of contact adhesive on its back surface and the cutout laminate is adhered thereby to the stone prior to sand blasting.

* * * * *